United States Patent [19]

Holuba

[11] 4,151,381

[45] Apr. 24, 1979

[54] REVERSAL STOP DEVICE

[75] Inventor: Henry J. Holuba, Moline, Ill.

[73] Assignee: Montgomery Elevator Company, Moline, Ill.

[21] Appl. No.: 800,163

[22] Filed: May 25, 1977

[51] Int. Cl.[2] ..... H01H 3/16

[52] U.S. Cl. ..... 200/61.39; 200/61.41; 200/153 T

[58] Field of Search ..... 200/61.39, 61.41, 61.42, 200/153 T, 31 R, 330, 337; 340/271

[56] References Cited

U.S. PATENT DOCUMENTS

| | | | |
|---|---|---|---|
| 2,736,011 | 2/1956 | Previti | 200/61.39 |
| 3,274,351 | 9/1966 | Halpine et al. | 200/61.41 |
| 3,300,701 | 1/1967 | Miller et al. | 200/61.39 X |
| 3,846,597 | 11/1974 | Ziegler, Jr. | 200/31 R X |

*Primary Examiner*—James R. Scott

*Attorney, Agent, or Firm*—Wegner, Stellman, McCord, Wiles & Wood

[57] ABSTRACT

A switch mechanism senses the rotational direction of a rotating member so that reversal of direction acts through a control switch to energize or de-energize an electric circuit. The mechanism has a reciprocable switch actuator frictionally engaging the rotating member, whereby rotation of the rotating member in one direction pulls the actuator and rotation in the other direction pushes the actuator to operate the control switch. The rotating member may be a shaft, or it may be an idler wheel driven by the shaft, so that the rotational direction of the shaft is sensed and actuates the control switch. Herein, the switch mechanism senses the rotational direction of an output shaft in an escalator drive train. Accidental loss of motor torque when the escalator is in the "up" mode may permit reverse rotation of the output shaft as the escalator starts down under the weight of the passengers, but actuation of the control switch drops the up direction contactor and sets a brake.

12 Claims, 5 Drawing Figures

N.O

REVERSAL STOP DEVICE

BACKGROUND OF THE INVENTION

This invention generally relates to a switch mechanism for sensing the rotation of a shaft and, more particularly, to a safety switch mechanism employed in an escalator or power ramp to terminate operation thereof when an output shaft in the drive train reverses its rotation when the motor is driving the escalator or ramp upwardly. While the invention is particularly useful in conjunction with escalators or power ramps, it need not be so limited and may be employed in many fields.

Escalators and power ramps are specialized endless conveyors. Typically, a motor operates through a drive train including a gearbox to drive a main drive sprocket for the endless conveyor. Various controls are utilized to provide safety for passengers. These controls include a safety brake which automatically goes into operation when power to the motor is cut off. When an escalator is to be driven in the up direction, the motor control circuit is closed through a key-operated "up" switch, momentarily manually operated, which causes the motor to drive the escalator in an up mode until some protective safety switch operates, or until the escalator is turned off manually.

If the drive motor and the drive sprocket, which moves the conveyor, cannot move the conveyor and its load in the up direction, the conveyor can "freewheel" in the downward direction under the weight of the passengers upon it. It is therefore necessary in such circumstances to provide a means for opening the motor control circuit in order to set the brake and restrain downward movement of the conveyor.

SUMMARY OF THE INVENTION

It is the principal object of the invention to provide a relatively simple and effective means to sense improper rotation of the drive shaft of an escalator and operate a switch to de-energize the drive direction contactor and thus set the brake. More particularly, it is an object of the invention to provide a switch mechanism which is dependent upon rotation of the escalator drive shaft coinciding with the engagement of the appropriate motor direction contactor.

In accordance with the invention, a switch mechanism for controlling the energization of an electric circuit in accordance with the rotational direction of a rotating member includes a control switch and a reciprocable actuator having one part thereof adapted to operate the switch and another part thereof for frictionally engaging the rotating member. Rotation of the rotating member in one direction causes the actuator to be moved to one position, while rotation in the opposite direction causes the actuator to be moved to another position. As a result, appropriate activation or deactivation of the switch is effected to complete or interrupt the electric circuit.

The switch mechanism is advantageously employed with a conveyor, such as an escalator, to detect movement of the conveyor opposite to that which had been selected for operation. The control switch of the switch mechanism is incorporated into the escalator control circuit, which has manually operated momentary switches for selecting up or down modes of operation. Herein, the control switch is utilized in connection with the drive shaft to determine whether the drive shaft is rotating in a direction corresponding to that which the motor is intended to run. If the drive shaft is being improperly rotated, the control switch is operative to terminate operation of the motor so that a brake is set.

In an exemplary embodiment of the invention, the rotating member engages a shaft whose rotation is to be determined. The rotating member when employed as an idler wheel rests on the shaft because of its weight and rotates in response to rotation of the shaft. Consequently, there is no necessity to modify the shaft to accommodate the switch mechanism.

In a preferred embodiment of the invention, the peripheral surface of the rotating member has a groove therein that has a cross-sectional configuration which corresponds to the configuration of the actuator which is positioned therein so as to increase contact therebetween and maintain engagement thereof.

In a highly preferred embodiment of the invention, the periphery of the rotating member and its groove is coated with wear resistant material having a high coefficient of friction.

A feature of the invention is that constant adjustment of the switch mechanism is not required because of wear. The actuator will always be moved only as far as is necessary for operation of the control switch.

Further features and advantages of the invention will become apparent from the following description taken in conjunction with the accompanying drawings.

DESCRIPTION OF THE PREFERRED EMBODIMENT

Figures 1, 2:
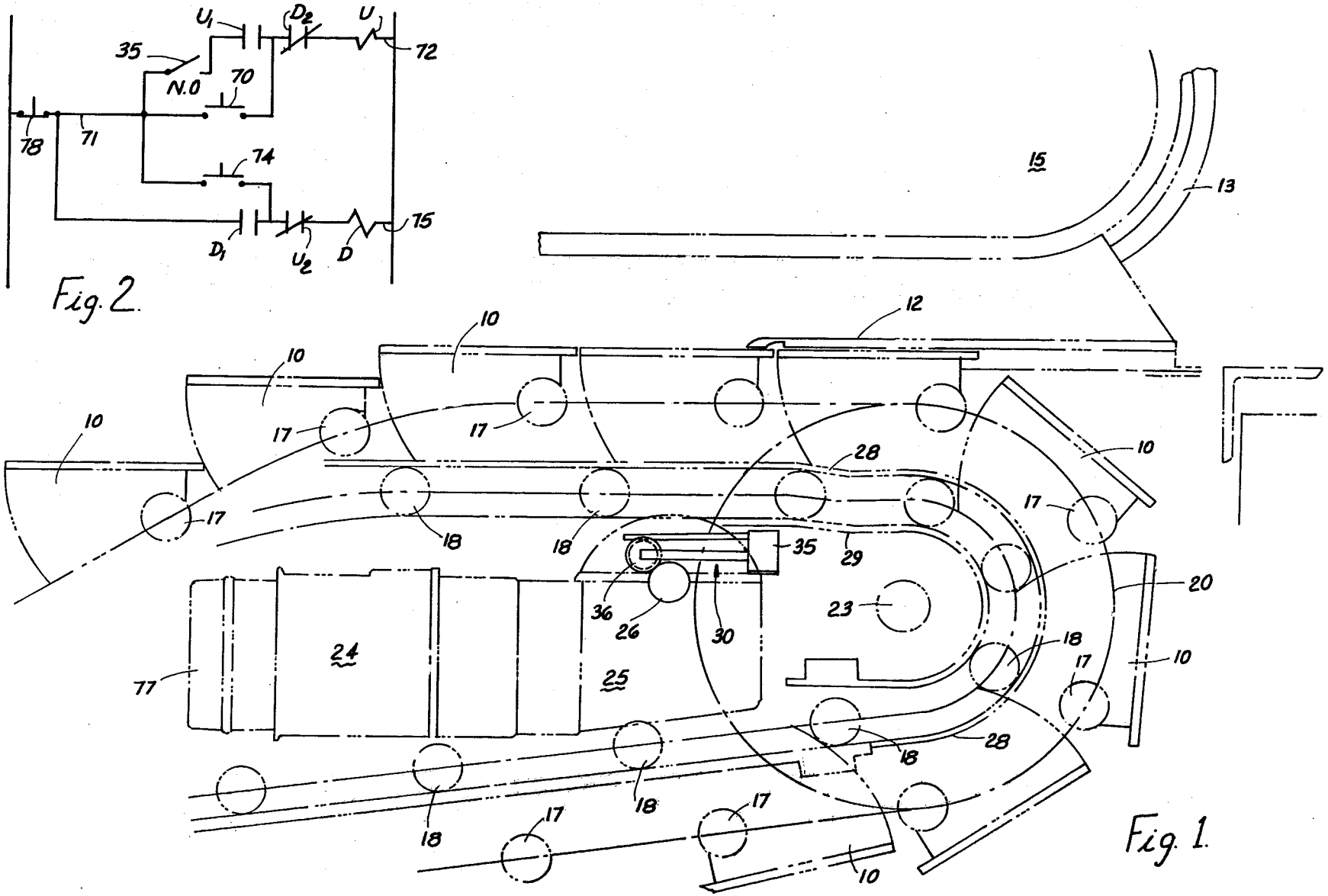
FIG. 1 is a fragmentary cross-sectional view of the upper landing of an escalator in which the switch mechanism of the invention is incorporated, with the escalator in broken lines and the switch mechanism in solid lines.
FIG. 2 is a schematic diagram of an electrical circuit for controlling operation of the escalator in which the control switch is incorporated.

Referring to FIG. 1, an escalator in which the invention may be utilized has an endless series of steps 10 adapted to carry passengers between an upper landing 12 and a lower landing (not shown). A moving handrail 13, which is a continuous loop, is provided at each side of the steps 10 for passengers to grip. Each handrail 13 is driven synchronously with the moving steps 10 and is guided and supported at a convenient exposed height by a balustrade 15.

Each of the steps 10 has wheels 17 and trailer wheels 18. To effect circuitous movement of the steps 10, the wheels 17 are engaged at the upper landing station by a drive sprocket 20 which is mounted on a shaft 23 and rotated by an electric motor 24 through a drive gear box 25 via a pinion to gear drive (not shown) between the shaft 23 and the main output shaft 26 of the gear box 25. At the upper landing station the trailer wheels 18 enter an arcuate channel defined by outer guide rail 28 and inner guide rail 29. The direction of the steps, after reaching the upper landing 12, is thereby reversed so that the steps travel downwardly to the lower landing under the upwardly moving exposed steps.

Figure 5:
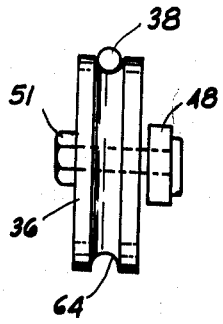
FIG. 5 is a front elevational view of the idler wheel and the actuator of the switch mechanism.
Figure 4:
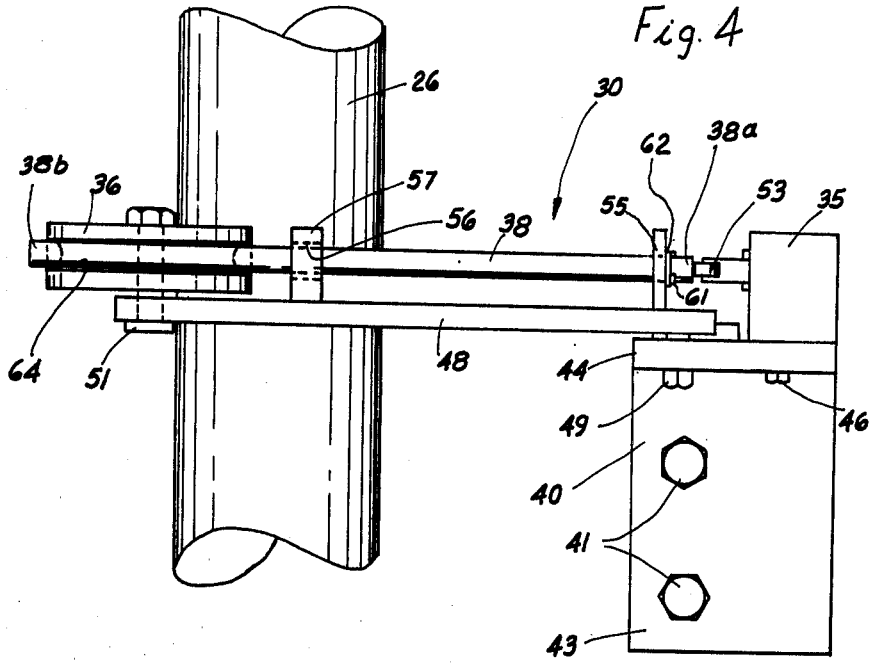
FIG. 4 is a plan view of the switch mechanism shown in FIG. 3.
Figure 3:
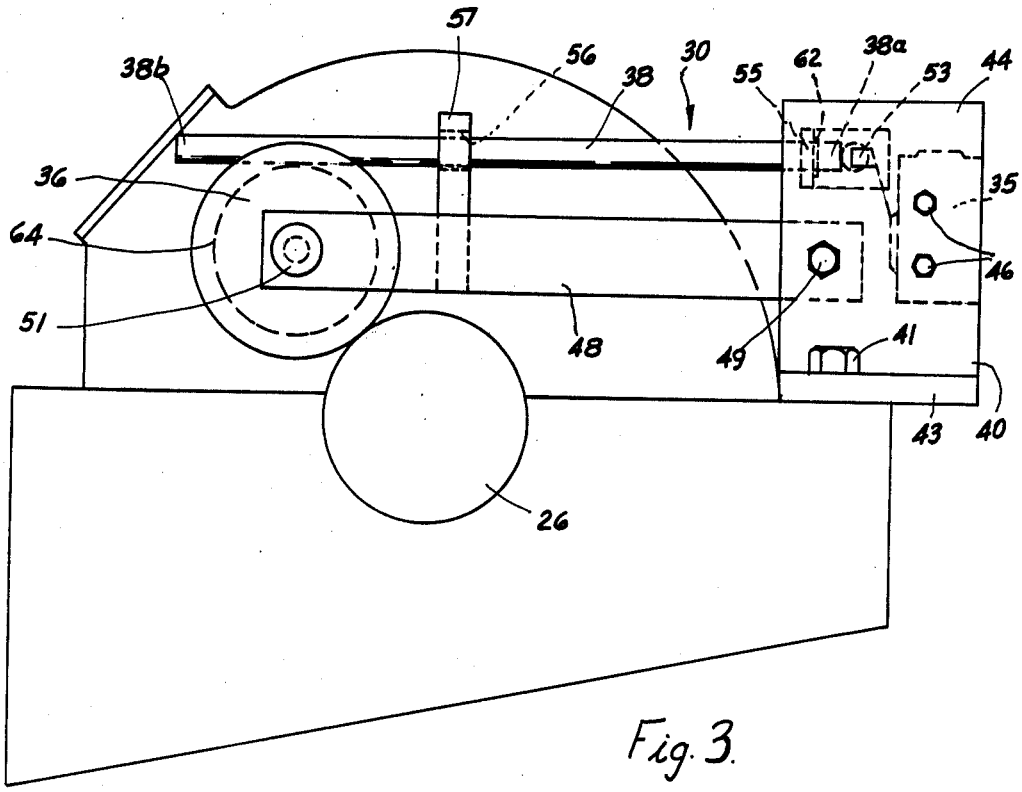
FIG. 3 is an enlarged side elevational view of the switch mechanism shown in FIG. 1 particularly illustrating its relationship with the main output shaft of the gear box.

The rotational control switch mechanism, generally designated 30, is mounted on the cover of the gear box 25 and cooperates with the output shaft 26. Referring to FIGS. 3–5, the rotational control switch mechanism 30 is seen to broadly include a limit switch 35, an idler wheel 36 partially supported by the output shaft 26 and adapted to rotate in response to rotation of the output shaft 26, and a switch actuator rod, or rubbing bar 38, which is supported on the circumferential periphery of the idler wheel 36 and adapted to actuate the limit switch 35 when moved. The weight of the actuator rod 38 effects slight frictional engagement between the actuator rod 38 and the idler wheel 36 on which it rests.

An L-shaped mounting bracket 40 is secured to the gear box 25 by a pair of bolts 41 extending through a bracket base portion 43; and an upright arm 44 of the bracket 40 is in a plane generally normal to the axis of the output shaft 26 and supports the limit switch 35 which is secured thereto by screws 46. An elongate idler carrier arm 48 has one end pivotally mounted on the bracket portions 44 by a bolt 49 so that the carrier arm 48 swings about an axis generally parallel to the axis of the output shaft 26. A bolt 51 extends through the free end of the carrier arm 48 parallel to the axis of the output shaft 26; and the idler wheel 36 is journalled on said bolt. When the idler wheel 36 is resting on the output shaft 26 the carrier is generally horizontal.

The actuator 38 is slidably supported in a retainer guide 55 on the bracket 40 and traverses a bore 56 in a guide 57 carrier by the carrier arm 48. The actuator has an end **38*a* abutting a switch plunger 53, and has an end portion 38*b* resting on the idler wheel 36. The actuator 38 is impaled by a cotter pin 61 between the retainer guide 55 and the switch plunger 53, and a washer 62 between the cotter pin 61 and the retainer guide 55 provides a stop to prevent excessive movement of the actuator 38 away from the switch plunger 53**.

The idler wheel 36 has a circumferential groove 64 having a cross-sectional configuration corresponding to the cross-sectional configuration of the actuator rod 38. Herein, the groove 64 has a semicircular cross section, while the actuator rod 38 is cylindrical. It is evident, however, that other configurations could advantageously be employed. The periphery of the idler wheel 36 is preferably covered with polyurethane to increase its wearing qualities and to increase frictional engagement thereof with the output shaft 26 and the actuation rod 38 while also reducing wear of the output shaft 26. The rod guide 57 and the retainer guide 55 radially restrain the actuator rod 38 to ensure constant engagement of the rod 38 in the peripheral groove 64 of the idler wheel 36 and to also ensure proper alignment with the limit switch 35.

In operation, when the steps 10 are moved upwardly, the shaft 23 rotates in a clockwise direction and the output shaft 26 rotates counterclockwise. The idler wheel 36 rotates in a clockwise direction thereby causing the actuator rod 38 to be pushed into the operating plunger 53 of limit switch 35. However, if accidental loss of motor torque causes the main output shaft to rotate clockwise, the idler wheel 36 will rotate counterclockwise and thus pull the actuator rod away from the limit switch 35 until the washer 62 abuts the retainer guide 55. The free sliding mounting of the actuator rod 38 eliminates any need for regular adjustment of the mechanism.

The limit switch 35 is incorporated into the electrical control circuit for the escalator seen in FIG. 2. The limit switch 35 is normally open. By momentarily depressing switch 70, power delivered from source line 71 through the line 72 energizes relay U through normally-closed contact $D_2$ so as to close normally-open contact $U_1$ and open normally-closed contact $U_2$. As a result, upward movement of the steps 10 is achieved thereby closing limit switch 35 to complete the holding circuit and continue operation of the motor 24 after the switch 70 is released. Thereafter, any downward travel of the steps 10 will effect reverse rotation of the shaft 26 through the sprocket 20 and deactivate the limit switch 35 to berak the circuit controlling the motor 24 through line 72. When operation of the motor 24 is terminated, a safety brake 77 associated therewith goes into operation to limit downward movement of the steps 10 as is customary in escalator control systems.

The disclosed arrangement has no effect on the operation of the escalator in the downward direction. By momentarily depressing switch 74, power is delivered via line 75 and relay D is energized through normally closed contact $U_2$ thereby closing normally-open contact $D_1$. A normally-closed switch 78 is also provided to enable an operator to stop the escalator.

It would be an obvious expedient to eliminate the idler wheel 36 and rest the actuation rod 38 directly on the output shaft 26 and still achieve similar results. However, the idler wheel 36 with the polyurethane covering has several advantages, the most important of which are:

1. The idler wheel and actuation rod can be fabricated economically and to close mating tolerances;
2. Installation is cheaper and much easier on existing escalators; and
3. Wear of the output shaft 26 is minimized.

I claim:

1. A switch mechanism for controlling the energization of an electric circuit in accordance with the rotational direction of a rotating member which has a circular surface, said switch mechanism comprising in combination:

a switch incorporated in the electric circuit and having an operating member mounted for reciprocal movement for activating and deactivating said switch;

guide means for guiding a rod endwise to move said switch operating member;

an actuator rod supported by said guide means for endwise movement, said actuator rod having a first end immediately adjacent the switch operating member and having a second end portion supported on and maintained by its own weight in frictional engagement with the circular surface of the rotating member, whereby rotation of the rotating member in one direction frictionally urges said actuator rod to a normal position against the switch operating member to activate the switch, and rotation of said rotating member in the opposite direction frictionally moves said actuator rod to a release position away from the switch operating member, releasing said operating member and deactivating said switch, and said actuator rod slides on said rotating member in both said positions;

and stop means for limiting the movement of the actuator rod away from the switch operating member.

2. The combination of claim 1 in which the guide means comprises a bracket close to the switch operating member provided with a rod guide and support surface and the actuator rod rests loosely on said support surface.

3. The combination of claim 2 in which the rod guide and support surface is the lower portion of a guide bore in the bracket.

4. The combination of claim 3 which includes a second bracket close to the rotating member, said second bracket having a confining guide bore the periphery of which surrounds and is in spaced relationship to the actuator rod.

5. The combination of claim 1 in which the stop means comprises a radially projecting flange on the actuator rod which abuts a part of the guide means to limit movement of the actuator rod.

6. The combination of claim 1 wherein said rotating member engages a rotatable shaft having a rotational axis generally parallel to the rotational axis of said rotating member, said shaft supplying rotational torque to said rotating member to effect rotation thereof.

7. The combination of claim 6 wherein said rotating member is rotatably carried by a carrier arm, said carrier arm being pivotally mounted to position said rotating member in overlying relationship with said shaft with the weight of the rotating member maintaining engagement therebetween.

8. The combination of claim 7 wherein said rotating member frictionally engages said shaft and has a circumferential surface of wear resistant material.

9. The combination of claim 1 wherein said rotating member has a circumferential peripheral groove in which said actuator is positioned, said groove having a surface of wear resistant material with a high coefficient of friction, and said groove and said actuator rod having corresponding cross-sectional configurations to increase the frictional contact therebetween.

10. In an endless passenger conveyor having an electrically-operated motor, a shaft rotatively driven by the motor and operatively connected to the conveyor to effect . circuitous movement thereof, and an electric circuit for controlling operation of the motor, a switch mechanism for controlling the energization of said electric circuit in accordance with the rotational movement of the shaft, said switch mechanism comprising in combination:

a switch incorporated in the electric circuit, said switch having an operating member for activating and deactivating said switch;

a rotatable member having a circular surface supported on the shaft so as to be frictionally rotated in response to rotation of the shaft;

guide means for guiding a rod endwise to move said switch operating member;

an actuator rod supported by said guide means for endwise movement, said actuator rod having a first end immediately adjacent the switch operating member and having a second end portion supported on and maintained by its own weight in frictional engagement with the circular surface of the rotating member, whereby rotation of the rotating member in one direction frictionally urges said actuator rod to a normal position against the switch operating member to activate the switch, and rotation of said rotating member in the opposite direction frictionally moves said actuator rod to a release position away from the switch operating member, releasing said operating member and deactivating said switch, and said actuator rod slides on said rotating member in both said positions;

and stop means for limiting the movement of the actuator rod away from the switch operating member.

11. The combination of claim 10 wherein said rotating member is rotatably carried by a carrier arm, said carrier arm being pivotally mounted to position said rotating member in overlying relationship with said shaft with the weight of the rotating member maintaining engagement therebetween.

12. The combination of claim 11 wherein said rotating member has a circumferential peripheral groove in which said actuator is positioned, said groove having a surface of wear resistant material with a high coefficient of friction, and said groove and said actuator rod having corresponding cross-sectional configurations to increase the frictional contact therebetween.

* * * * *